US006734794B2

(12) United States Patent
Robbins et al.

(10) Patent No.: US 6,734,794 B2
(45) Date of Patent: May 11, 2004

(54) ALARM CONTROL ALGORITHM FOR MULTI-SOURCED ALARMS

(75) Inventors: John R. Robbins, Desert Hills, AZ (US); Frank Sciabica, Phoenix, AZ (US)

(73) Assignee: AG Communication Systems Corporation, Phoenix, AZ (US)

( * ) Notice: Subject to any disclaimer, the term of this patent is extended or adjusted under 35 U.S.C. 154(b) by 96 days.

(21) Appl. No.: 10/084,084

(22) Filed: Feb. 27, 2002

(65) Prior Publication Data

US 2003/0160691 A1 Aug. 28, 2003

(51) Int. Cl.[7] ..... G08B 19/00

(52) U.S. Cl. ..... 340/521; 340/506; 340/507; 340/517; 702/187

(58) Field of Search ..... 340/506, 507, 340/517, 525, 514, 519, 520, 521, 522, 3.43; 700/12, 17, 83; 702/187

(56) References Cited

U.S. PATENT DOCUMENTS

| | | | | | |
|---|---|---|---|---|---|
| 4,117,479 | A | * | 9/1978 | Galvin et al. | 340/506 |
| 4,321,592 | A | * | 3/1982 | Crandall et al. | 340/541 |
| 4,749,985 | A | * | 6/1988 | Corsberg | 340/517 |
| 5,923,247 | A | * | 7/1999 | Dowden et al. | 340/506 |

* cited by examiner

*Primary Examiner*—Donnie L. Crosland
(74) *Attorney, Agent, or Firm*—David J. Zwick; Steven R. Santema

(57) ABSTRACT

A state machine that allows an audible alarm for a given fault condition to be extinguished while allowing subsequent audible alarms for different fault conditions.

4 Claims, 1 Drawing Sheet

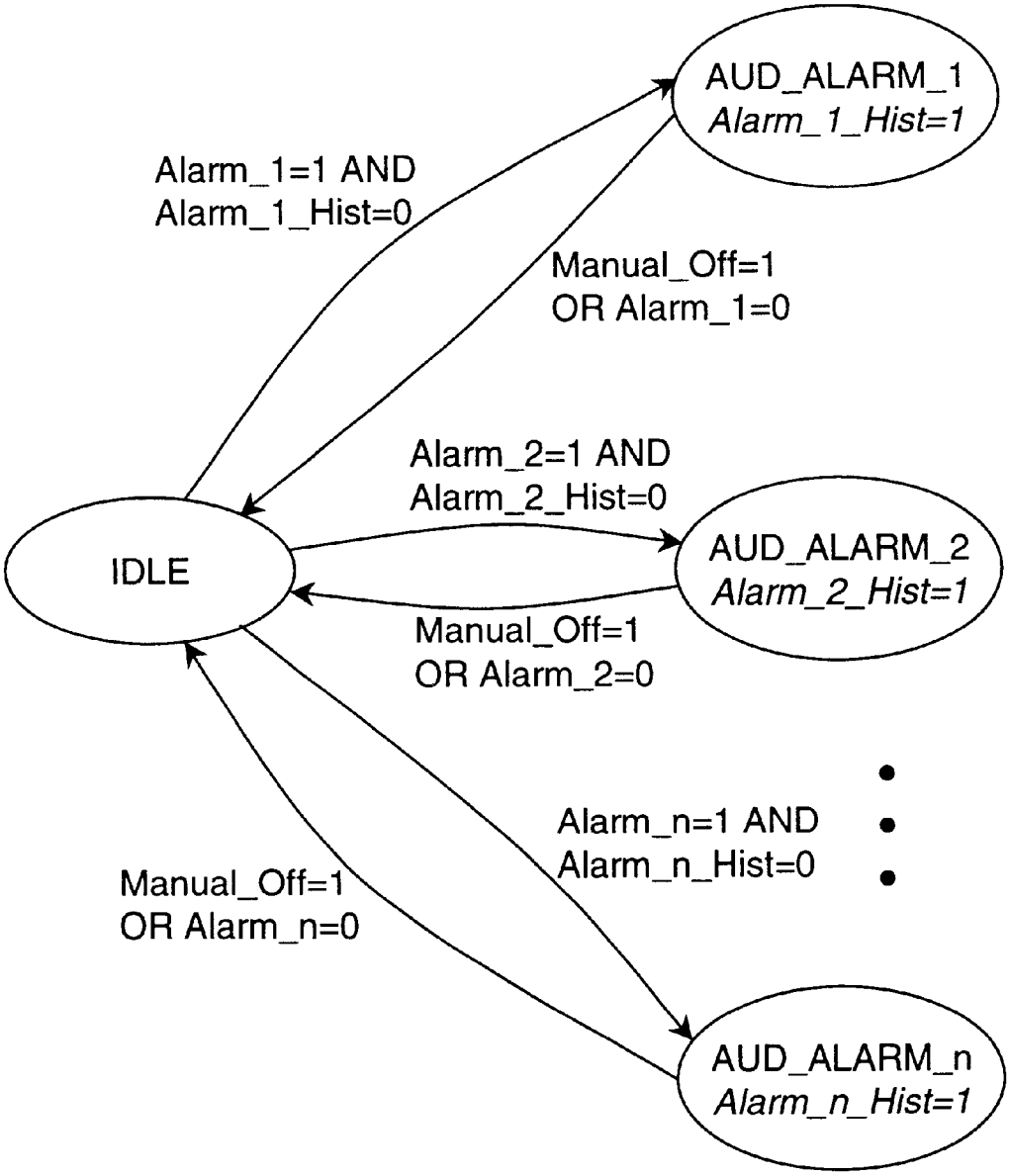
AUD_ALARM_1
Alarm_1_Hist=1
Alarm_1=1 AND
Alarm_1_Hist=0
Manual_Off=1
OR Alarm_1=0
Alarm_2=1 AND
Alarm_2_Hist=0
IDLE
AUD_ALARM_2
Alarm_2_Hist=1
Manual_Off=1
OR Alarm_2=0
Alarm_n=1 AND
Alarm_n_Hist=0
Manual_Off=1
OR Alarm_n=0
AUD_ALARM_n
Alarm_n_Hist=1

ALARM CONTROL ALGORITHM FOR MULTI-SOURCED ALARMS

FIELD OF THE INVENTION

The present invention relates to fault management, and more particularly to a method of silencing an audible alarm for a fault condition while allowing the audible alarm to trigger for other fault conditions.

BACKGROUND OF THE INVENTION

In many large and complex electronics systems, for example telecommunications systems, hardware and software components can fail, causing fault conditions. These fault conditions generally prevent the hardware or software components from performing their functions. These systems usually include a comprehensive fault management system, which includes an alarm management system, of which one component typically is an audible alarm that signals the occurrence of a fault, or alarm, condition that may require craftsperson intervention.

When a craftsperson is onsite working towards the diagnosis and resolution of a fault condition, the first thing the craftsperson typically does is to extinguish the audible alarm. The alarm management system typically handles the request to extinguish the audible alarm in on of two ways. The first approach is to disable the alarm for the present occurrence of the fault condition. The second approach is to disable the alarm for all fault occurrences until the alarm is reset manually or automatically.

A problem with the first approach is that subsequent occurrences of the fault condition will again trigger the audible alarm, forcing the craftsperson to repeatedly extinguish the audible alarm while working towards a resolution. Repeated occurrences of the same fault condition while the craftsperson is working towards a resolution of the problem do not typically aid in the problem resolution.

A problem with the second approach is that permanently disabling the audible alarm will cause subsequent alarms, which may be for potentially more critical conditions, to be ignored by the craftsperson.

SUMMARY OF THE INVENTION

Accordingly, it is an object of the present invention to provide a method by which an alarm management system will allow an audible alarm for a fault condition to be extinguished by a craftsperson, and will allow the alarm to sound for subsequent different fault conditions.

In an exemplary embodiment of the present invention, a state machine based method allows an audible alarm for a given fault condition to be extinguished while allowing subsequent audible alarms for different fault conditions.

DESCRIPTION OF THE DRAWINGS

The FIGURE shows an audible alarm controller state machine diagram of a preferred embodiment of the present invention.

DESCRIPTION OF THE PREFERRED EMBODIMENT

The FIGURE shows an audible alarm controller state machine diagram of a preferred embodiment of the present invention. Typically, such a state machine would control a set of alarms having the same general priority level. An alarm management system would have other such state machines controlling sets of alarms of other priority levels, and logic to allow higher priority alarms to take precedence over lower priority alarms.

In the preferred embodiment of the FIGURE, the audible alarm controller state machine receives input from a plurality of alarms, referenced generally in the state diagram as Alarm_1 through Alarm_n. After system startup and before any alarm occurrences, the state machine is in state IDLE. When a fault condition occurs, for example the condition associated with Alarm_1, the state machine detects the leading edge of signal Alarm_1 and moves to state AUD_ALARM_1. In this state, history flag Alarm_1_Hist is set, indicating that this fault has occurred, and the audible alarm is sounded. The state machine stays in this state, with the audible alarm continuing to sound, until the craftsperson punches a momentary contact manual shutoff button, whereupon the state machine detects the leading edge of signal Manual_Off, or signal Alarm_1 returns to zero through software control. When the state machine detects the edge of signal Manual_Off or signal Alarm_1 returns to zero, the state machine returns to state IDLE.

On a subsequent occurrence of signal Alarm_1, the audible alarm controller state machine will remain in state IDLE because history flag Alarm_1_Hist has been set. However, other first time fault occurrences will cause the state machine to move to the appropriate audible alarm state.

Additional reset logic not shown but typically included in the alarm management system will be readily understood by someone skilled in the art. This reset logic typically is triggered by a system reset or periodic software logic specifically directed to the alarm management system, and would, for example, reset all alarms and their associated history flags, and move the audible alarm controller state machine to state IDLE.

As can be seen from the FIGURE, it is possible that an alarm can be masked. For example, if signal Alarm_2 occurs while in state AUD_ALARM_1, then upon return to state IDLE following signal Manual_Off, transition to state AUD_ALARM_2 from state IDLE will not occur. It is assumed that the craftsperson, while actively working towards a diagnosis and resolution of the Alarm_1 fault condition, will be notified, for example through the system console, that signal Alarm_2 has occurred.

Although the FIGURE and preceding description describe a preferred embodiment of the present invention, alternative embodiments are allowed. For example, if it is advantageous that certain faults trigger an audible alarm on each occurrence, the associated alarm history flags may be hard-coded as permanently not set. It will also be understood by those skilled in the art that, while an audible alarm is described, the audible alarm controller state machine can equivalently control other external indicators, such as visual indicators or output signals. For purposes of brevity in the disclosure and claims, the term audible alarm, as used herein to indicate an external audible indicator, should be taken to also include other external indicators, such as visual indicators and output signals.

Applicants' invention is typically implemented as a hardware state machine in a programmable logic device (PLD) on a printed circuit board (PCB). Commercially available PLD programming systems may be used to aid in the programming of the PLD. The invention may also be implemented using discrete components on a PCB.

While the inventive system has been particularly shown and described, it is not intended to be exhaustive nor to limit the invention to the embodiment disclosed. It will be apparent to those skilled in the art that modifications can be made to the present invention without departing from the scope and spirit thereof. It is intended that the scope of the invention be defined by the claims appended hereto and their equivalents.

What is claimed is:

1. An audible alarm controller for controlling an audible alarm, receiving a plurality of alarm signals, each of said alarm signals corresponding to the occurrence of a different fault condition, and receiving a manual alarm off signal, said audible alarm controller comprising:

an idle state in which said audible alarm is not sounded;

a plurality of audible alarm states, said audible alarm states in one-to-one correspondence to said alarm signals;

each of said audible alarm states comprising logic to sound said audible alarm, an alarm history flag, and logic to set said alarm history flag indicating that the corresponding fault condition has occurred;

said idle state comprising logic operated in response to the assertion of one of said alarm signals, to move to the corresponding one of said audible alarm states if the corresponding said alarm history flag is not set; and each of said audible alarm states further comprising logic to return to said idle state when said manual alarm off signal is asserted.

2. An audible alarm controller according to claim 1, wherein certain of said corresponding alarm history flags are permanently not set.

3. A method for controlling an audible alarm, said method comprising:

waiting in an idle state in which said audible alarm is not sounded;

receiving an alarm signal of a plurality of alarm signals indicating the occurrence of a fault condition corresponding to said alarm signal;

remaining in said idle state if an alarm history flag corresponding to said alarm signal is set;

sounding said audible alarm if said corresponding alarm history flag is not set, and setting said corresponding alarm history flag;

receiving a manual off signal;

extinguishing said audible alarm in response to receiving said manual off signal; and returning to said waiting in an idle state step.

4. A method according to claim 3, wherein certain of said corresponding alarm history flags are permanently not set.

* * * * *